US005453138A

United States Patent [19]

Inoue et al.

[11] Patent Number: 5,453,138

[45] Date of Patent: Sep. 26, 1995

[54] ALLOY SHEET

[75] Inventors: Tadashi Inoue; Kiyoshi Tsuru; Tomoyoshi Okita; Michihito Hiasa, all of Kawasaki, Japan

[73] Assignee: NKK Corporation, Tokyo, Japan

[21] Appl. No.: 183,121

[22] Filed: Jan. 18, 1994

Related U.S. Application Data

[63] Continuation-in-part of Ser. No. 7,755, Jan. 22, 1993.

[30] Foreign Application Priority Data

Feb. 28, 1992 [JP] Japan ..... 4-078506
Aug. 27, 1993 [JP] Japan ..... 5-213001

[51] Int. Cl.[6] ..... C22C 38/40; C22C 38/52

[52] U.S. Cl. ..... 148/308; 148/310; 420/95; 420/97

[58] Field of Search ..... 148/308, 310, 148/333; 420/95, 97

[56] References Cited

U.S. PATENT DOCUMENTS

| | | | |
|---|---|---|---|
| 4,724,012 | 2/1988 | Inaba et al. | 148/327 |
| 4,751,424 | 6/1988 | Tong | 420/94 |
| 5,127,965 | 7/1992 | Inoue et al. | 148/500 |
| 5,158,624 | 10/1992 | Okiyama et al. | 148/310 |
| 5,207,844 | 5/1993 | Watanabe et al. | 148/310 |
| 5,234,512 | 8/1993 | Inoue et al. | 148/541 |
| 5,234,513 | 8/1993 | Inoue et al. | 148/541 |
| 5,308,723 | 5/1994 | Inoue et al. | 430/23 |

FOREIGN PATENT DOCUMENTS

| | | |
|---|---|---|
| 0104453 | 4/1984 | European Pat. Off. . |
| 0174196 | 3/1986 | European Pat. Off. . |
| 0552800 | 7/1993 | European Pat. Off. . |
| 0561120 | 9/1993 | European Pat. Off. . |
| 2664908 | 1/1992 | France . |
| 2668498 | 4/1992 | France . |
| 3636815 | 5/1987 | Germany . |
| 3642205 | 1/1988 | Germany . |
| 59-59861 | 4/1984 | Japan . |
| 61-19737 | 1/1986 | Japan . |
| 61-113747 | 5/1986 | Japan . |
| 63-259054 | 10/1988 | Japan . |
| 64-52024 | 2/1989 | Japan . |
| 3-197645 | 8/1991 | Japan . |
| 3-267320 | 11/1991 | Japan . |
| WO91/12345 | 8/1991 | WIPO . |

OTHER PUBLICATIONS

Derwent Abstract of JP 61–19737, Jan. 1986.

Patent Abstracts of Japan, vol. 15, No. 461 (C–0887), Nov. 22, 1991, of JP 03 197 645 (Nippon Mining Co., Ltd.), Aug. 29, 1991.

Patent Abstracts of Japan, vol. 15, No. 92 (C–0811), Mar. 6, 1991, of JP 02 305 941 (Toyo Kohan Co., Ltd.), Dec. 19, 1990.

Patent Abstracts Of Japan, vol. 13, No. 69 (C–569), Feb. 16, 1989, of JP 63 259 054 (Nippon Mining Co., Ltd.), Oct. 26, 1988.

Patent Abstracts Of Japan, vol. 10, No. 296 (C–377), Oct. 8, 1986, of JP 61 113 747 (Nippon Mining Co., Ltd.), May 31, 1986.

Patent Abstracts Of Japan, vol. 10, No. 196 (C–377), Oct. 8, 1986, of JP 61 113 746 (Nippon Mining Co., Ltd.), May 31, 1986.

(List continued on next page.)

*Primary Examiner*—George Wyszomierski

*Attorney, Agent, or Firm*—Frishauf, Holtz, Goodman, Langer & Chick

[57] ABSTRACT

An alloy sheet containing Fe, Ni and Cr has an average austenite grain size of 15 to 45 μm and a degree of mixed grain for austenite grain size of 4.5 to 50%; the alloy sheet has a gathering degree of the {331} plane on a surface of the alloy sheet of 8 to 35%, a gathering degree of the {210} plane of 1 to 20% and a gathering degree of the {211} plane of 2 to 20%; the degree of mixed grain is expressed by the equation: (|0.5 Dmax–D|/D)×100 (%), where D is an average austenite grain size, and Dmax is a maximum austenite grain size in said alloy sheet.

29 Claims, 5 Drawing Sheets

OTHER PUBLICATIONS

Patent Abstracts Of Japan, vol. 15, No. 461 (C–0887), Nov. 22, 1991 of JP 3–197646 (Nippon Mining Co., Ltd.), Aug. 29, 1991.

Chemical Abstracts, p. 249, No. 133956d of JP–A–60 251 227, vol. 104, No. 16, Apr. 21, 1986.

Database WPIL, Week 8732, Derwent Publications Ltd., London, GB; AN 87–224995; abstract of JP–A–62–149 851, Jul. 1987.

Database WPIL, Week 8615, Derwent Publications Ltd., London, GB; AN 86–098295; abstract of JP–A–61–044 126, Mar. 1986.

Database WPIL, Week 8610, Derwent Publicaitions Ltd., London, GB; AN 86–066609; abstract of JP–A–61–019 737, Jan. 1986.

ALLOY SHEET

This application is a continuation-in-part of application Ser. No. 08/007,755 filed Jan. 22, 1993, which is incorporated herein in its entirety by this reference.

BACKGROUND OF THE INVENTION

1. Field of the Invention

The present invention relates to an alloy sheet for making a shadow mask used for a color cathode ray tube and a method for manufacturing thereof, in particular to an alloy sheet containing Fe, Ni and Cr having high press-formability and a method for manufacturing thereof.

2. Description of the Related Arts

The recent trend of up-grading of color television towards high definition TV has employed an Fe—Ni alloy containing 34 to 38 wt.% Ni as the alloy for making a shadow mask to suppress color-phase shift. Compared with low carbon steel which has long been used as a shadow mask material, conventional Fe—Ni alloy has considerably lower thermal expansion coefficient. Accordingly, a shadow mask made of conventional Fe—Ni alloy raises no problem of color-phase shift coming from the thermal expansion of a shadow mask even when an electron beam heats the shadow mask.

The common practice of making the alloy sheet for shadow mask includes the following steps. An alloy ingot is prepared by continuous casting process or ingot-making process. The alloy ingot is subjected to slabbing, hot-rolling, cold-rolling, and annealing to produce an alloy sheet.

The alloy sheet for making a shadow mask is then processed usually in the following steps to form shadow mask. (1) The alloy sheet is photo-etched to form passage-holes for the electron beam on the alloy sheet for making a shadow mask. The alloy sheet for making a shadow mask perforated by etching is hereinafter referred to as a "flat mask". (2) The flat mask is subjected to annealing. (3) The annealed flat mask is pressed into a curved shape of a cathode ray tube. (4) The press-formed flat mask is assembled to a shadow mask which is then subjected to a blackening treatment.

However, the above mentioned conventional Fe—Ni alloy has higher strength and plane anisotropy as mechanical properties than conventional low carbon steel. Accordingly, an alloy sheet for a shadow mask prepared by the process including first cold-rolling, recrystallization annealing and finish cold-rolling, which is annealed before press-forming after being perforated by etching, develops problems such as poor shape-fixability, cracking on the alloy sheet and blurred periphery of the pierced hole during press-forming, which is a significant disadvantage of manufacturing a cathode ray tube.

In addition, the above described Fe—Ni alloy gathers rust easily, which reduces production yield druing the manufacturing process of a shadow mask.

The prior art was proposed in JP-A-3-267320 (the term JP-A- referred to herein signifies an unexamined Japanese patent publication), where a method to decrease the strength of the conventional Fe—Ni alloy and solve the problems is provided. Hereafter, said art is referred to as prior art 1. The prior art 1 employs first cold-rolling, recrystallization annealing, finish cold-rolling and softening annealing. The finish cold-rolling is performed at a reduction ratio of 5 to 20%, and the temperature of the softening annealing is less than 800° C. The prior art 1 produces a sheet having sufficiently low strength to give good press-formability with the 0.2% proof stress of 9.5 kgf/mm$^2$ (10 kgf/mm$^2$ or less) at 200° C.

The prior art 2 was proposed in JP-B-64-52024, where a method to reduce a plane anisotropy as a mechanical property is provided. To produce a plate for a shadow mask having the less plane anisotropy of elastic coefficient, the prior art 2 employs a process including cold-rolling followed by recrystallization annealing repeated twice or more, and cold-rolling to increase hardness. In that process, finish cold-rolling before finish recrystallization annealing is performed at the reduction ratio of 40 to 80%. The plate a shadow mask has an excellent uniform formability during press-forming resulting in a small deformation of etched-hole and free from the irregular gloss and stringer defect when the plate is etched, annealed and press-formed.

However, the prior art 1 does not satisfy the quality required to perform a favorable warm press-forming, though the strength is lowered to the level suitable for press-forming under the above described annealing condition. The alloy sheet for a shadow mask prepared by the prior art was found to gall a die and to generate cracks at the edge of shadow masks. Furthermore, the above described alloy sheet for making a shadow mask often develops a quality problem of blurred periphery of pierced holes after press-forming, as the plane anisotropy of the alloy is large.

In the prior art 2, the plane anisotropy of elastic coefficient of the plate is small, and the blurred periphery of pierced holes according to the deformation of the holes during the press-forming is not observed. Still, the prior art 2 induces cracks at the edge of shadow mask during press-forming and does not improve the corrosion resistance of Fe—Ni alloy.

Present color televisions require severer quality specifications on color-phase shift because the color picture tubes directed to brighter and more flat faces than ever. The cathode ray tubes using the shadow masks prepared by the prior arts mentioned above give partial color-phase shift under electron beam irradiation.

SUMMARY OF THE INVENTION

The object of the present invention is to provide an alloy sheet for making a shadow mask having excellent corrosion resistance and high press-formability, which developes no crack nor blurred periphery of pierced holes during press-forming and does not generate a color phase shift when used for cathode ray tubes and a method for manufacturing thereof.

To achieve the object, the present invention provides an alloy sheet consisting essentially of 34 to 38 wt.% Ni, 0.05 to 3 wt.% Cr, 0.1 wt.% or less Si, 0.003 wt.% or less B, 0,003 wt.% or less O, 0.003 wt.% or less N and the balance being Fe;

said alloy sheet having an average austenite grains of 15 to 45 μm and a degree of mixed grain for austenite grain size of 50% or less, said degree of mixed grain being expressed by an equation of $(|0.5\ D_{max}-D|/D)\times 100$ (%), where D is an average austenite grain size, $D_{max}$ is a maximum austenite grain size in said alloy sheet, and $|0.5\ D_{max}-D|$ means an absolute value of $(0.5\ D_{max}-D)$; and a gathering degree of {331} plane on a surface of said alloy sheet being 35% or less, that of {210} plane 20% or less and that of {211} plane 20% or less.

Said alloy sheet may further include 1 wt.% or less Co. The present invention also provides an alloy sheet consisting essentially of 27 to 38 wt.% Ni, 0.05 to 3 wt.% Cr, over 1 to less than 7 wt.% Co, 0.1 wt.% or less Si, 0.003 wt.% or less B, 0.003 wt.% or less O, 0.003 wt.% or less N and the balance being Fe;

said alloy sheet having an average austenite grain size of 15 to 45 μm and a degree of mixed grain for austenite grains of 50% or less, said degree of mixed grain being expressed by an equation of (|0.5 Dmax–D|/D)×100 (%), where D is an average austenite grain size, Dmax is a maximum austenite grain size in said alloy sheet, and |0.5 Dmax—D| means an absolute value of (0.5 Dmax–D); and a gathering degree of {331} plane on a surface of said alloy sheet being 35% or less, that of {210} plane 20% or less and that of {211} plane of 20% or less.

The present invention also provides a method for manufacturing an alloy sheet comprising the steps of:

(a) hot-rolling a slab containing Fe, Ni and Cr into a hot-rolled strip;

(b) annealing said hot-rolled strip in a temperature range of 810° to 890° C.;

(c) cold-rolling said annealed hot-rolled strip at a reduction ratio of 81 to 94% into a cold-rolled sheet;

(d) a recrystallization annealing step of annealing said cold-rolled sheet;

(e) finish cold-rolling said cold-rolled sheet subjected to the recrystallization annealing at a reduction ratio of 14 to 29%;

(f) a stress relief annealing step of annealing said cold-rolled sheet subjected to the finish cold-rolling; and (g) ,annealing, before press-forming, the cold-rolled sheet subjected to the stress relief annealing in a temperature range of 740° to 900° C. for 2 to 40 min. and on conditions satisfying an equation below;

$$T \geqq -123\log t+937,$$

where T is a temperature (°C.) and t is s time (min.) for the annealing.

The present invention still further provides a method for manufacturing an alloy sheet comprising the steps of:

(a) hot-rolling a slab containing Fe, Ni and Cr into a hot-rolled strip;

(b) annealing said hot-rolled strip in a temperature range of 810° to 890° C.;

(c) a first cold-rolling step of cold-rolling said annealed hot-rolled strip at a reduction ratio of 40 to 55% into a cold-rolled sheet;

(d) a first recrystallization annealing step of annealing said cold-rolled sheet;

(e) a second cold-rolling step of cold rolling said cold-rolled sheet subjected to the recrystallization annealing at a reduction ratio of 81 to 94%;

(f) a second recrystallization step of annealing said cold-rolled sheet;

(g) finish cold-rolling the cold-rolled sheet subjected to the recrystallization annealing at a reduction ratio of 14 to 29%;

(h) a stress relief annealing step of annealing said cold-rolled sheet subjected to the finish cold-rolling; and (i) annealing, before press-forming, the cold-rolled sheet subjected to the stress relief annealing in a temperature range of 740° to 900° C. for 2 to 40 min. and on conditions satisfying the equation below;

$$T \geqq -123\log t+937,$$

where T(°C.) is the temperature and t (min.) is the time of the annealing.

DESCRIPTION OF THE PREFERRED EMBODIMENTS

Figure 1:
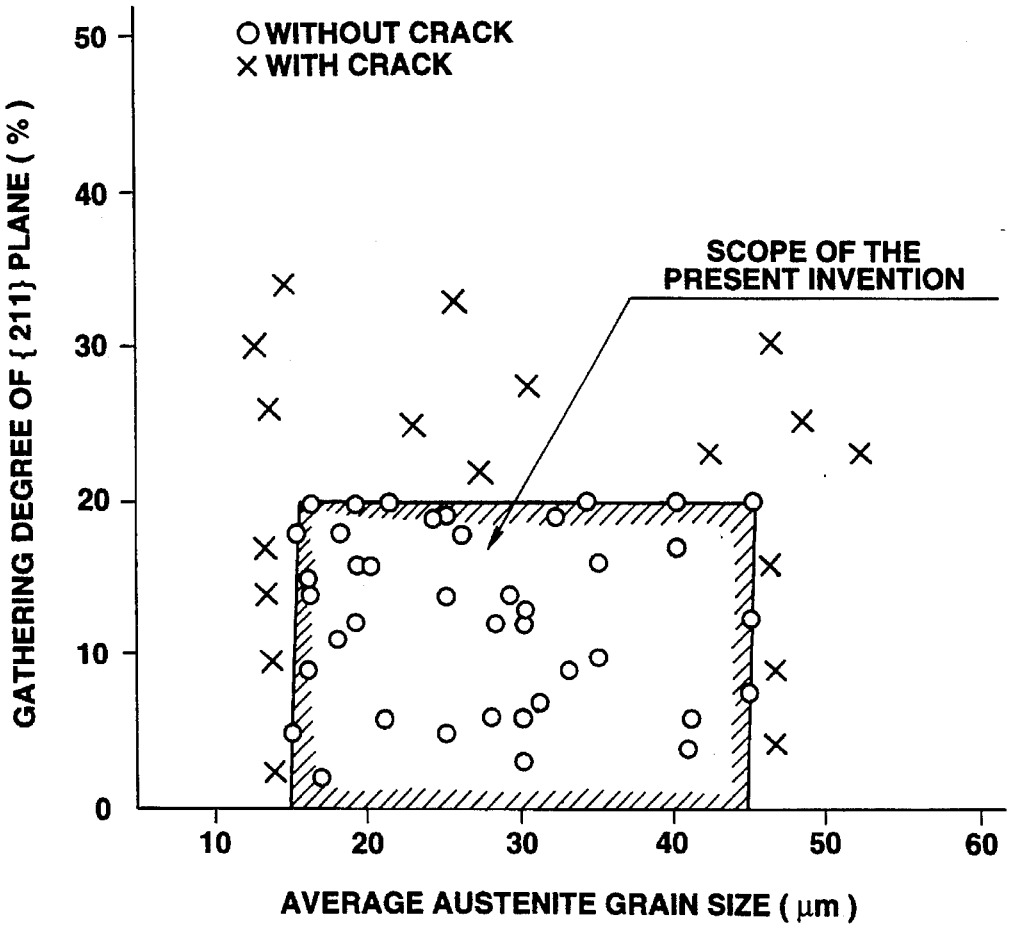
FIG. 1 is a graph showing a relation among crack generation during press-forming, gathering degree of the {211} plane, and average austenite grain size after the annealing before press-forming according to the present invention.

The inventors made an extensive study to develop a Fe—Ni alloy sheet and Fe—Ni—Cr alloy sheet for a shadow mask having a high press-formability and suppressing partial color phase shift and found that the desired press-fore, ability is obtained while suppressing the above mentioned color phase shift by adjusting the chemical composition, austenite grain size, degree of mixed grains for austenite grains, and crystal orientation of the Fe—Ni alloy sheet for making a shadow mask within a specified range.

The presence of B and O within a specified range enhances the growth of crystal grains during the annealing before press-forming. The growth of crystal grains yields the austenite grain having a specified size, which gives shape fixability during press-forming. Also the presence of Si and N within a specified range suppresses the galling of dies and improves the fitness to die during press-forming. The control of the gathering degree of the {211} plane on the alloy sheet after annealing before press-forming within a specified range suppresses the generation of cracks on material during press-forming.

By adjusting the degree of mixed grain for austenite grains after the annealing before press-forming within a specified range, the generation of blurred periphery of pierced holes during press-forming is suppressed. Also by adjusting the gathering degrees the of {210} plane and of the {331} plane of the alloy sheet after annealing before press-forming within a specified range, the above described color-phase shift can be suppressed.

In the manufacturing process of the alloy of the present invention, the hot-rolled strip is subjected to hot-rolled sheet annealing at a specific temperature before cold-rolling. Both cold-rolling and finish cold-rolling control their reduction ratio, and the annealing before press-forming controls the condition within each specified range. The average austenite grain size and gathering degree of the {331}, {210} and {211} planes on the surface of alloy sheet are adjusted within a specified range. To maintain the degree of mixed grain for austenite grains in the alloy sheet after the annealing before press-forming within a specified range, one or two of cold-rollings after the annealing of hot-rolled sheet are conducted under a reduction ratio within a specified range.

This invention has been derived based on the findings described above. The reason of specifying the chemical composition, austenite grain size and degree of mixed grain for austenite grains after annealing before press-forming, and the gathering degrees of the {331}, {210}, and {211} planes of the Fe—Ni alloy sheet and the Fe—Ni—Co—Cr alloy sheet surface for making a shadow mask of the present invention within the range above described is clarified in the following.

(1) Nickel:

To prevent color-phase shift, the Fe—Ni alloy sheet for making a shadow it mask is necessary to have the upper limit of average thermal expansion coefficient as approximately $2.0\times10^{-6}$/°C. in the temperature range of 30° to 100° C. The thermal expansion coefficient depends on the content of Ni in the alloy sheet. The Ni content which satisfies the above limitation of average thermal expansion coefficient is 34 to 38 wt.%. Consequently, the Ni content should be limited to 34 to 38 wt.%. More preferably, the Ni content to decrease average thermal expansion coefficient is 35 to 37 wt.%, and most preferably 35.5 to 36.5 wt.%.

When the alloy includes 0.001 to 1.0 wt.% cobalt, the Ni content to satisfy the upper limit of the average thermal expansion coefficient is 34 to 38 wt.%, and most preferably in a range of 35 to 38 wt.%. When the alloy includes over 1.0 to 7 wt.% Co, the range of Ni content to satisfy the above described condition of average thermal expansion coefficient is 27 to 38 wt.%, and the average thermal expansion coefficients of Fe—Ni—Co—Cr alloy and Fe—Ni—Cr alloy are further reduced by limiting the Ni content to 30 to 33 wt.% and Co to 3 to 6 wt.%.

Chromium improves the corrosion resistance of alloy, but increases the thermal expansion coefficient. A chromium content of less than 0.05% gives no effect of improvement in corrosion resistance. On the other hand, when the Cr content exceeds 3 wt.%, the alloy can not provide the average thermal expansion coefficient specified by the present invention. Therefore, the lower limit and the upper limit of Cr content are specified as 0.05 wt.% and 3.0 wt.%, respectively.

According to this invention, the average austenite grain size which is requested from the reason of improving shape fixability, suppressing the generation of crack on alloy sheet during press-forming and of preventing the blurred periphery of pierced hole after press-forming is 15 to 45 μm for warm press-forming. Grain size of less than 15 μm gives poor shape fixability and generates cracks on the alloy sheet. A grain size above 45 μm, however, generates cracks and blurred periphery of pierced hole after press-forming. Consequently, the average austenite grain size is specified as 15 to 45 μm.

To suppress the generation of cracks on the material, the control of the gathering degree of the {211} plane on alloy sheet within a specified range while maintaining the above described average austenite grain size is essential as described later. To enhance the grain growth under the condition of annealing before press-forming of this invention, the control of O and B content of a specified level or less is necessary. To improve the fitness to dies during press-forming, the control of Si and N content of the specified level or less is necessary. The following is the description of the content of such elements.

(2) Oxygen:

Oxygen is one of the inevitable impurities. Increased content of O increases the non-metallic oxide inclusion within the alloy, which inclusion suppresses the growth of crystal grains during the annealing before press-forming, particularly in the temperature range of 740° to 900° C. for 40 min. or less. If the content of O exceeds 0.0030 wt.%, then the growth of crystal grains described above is considerably suppressed, and no austenite grain size aimed in this invention is obtained. Consequently, the upper limit of O content is specified to 0.0030%.

(3) Boron:

Boron enhances the hot-workability of the alloy. Excess amount of B, however, induces the segregation of B at boundary of recrystallized grains formed during the annealing before press-forming, which inhibits the free migration of grain boundaries and results in the suppression of grain growth and the dissatisfaction of austenite grain size after the annealing before press-forming. In particular, under the annealing condition before press-forming, which is specified in this invention, the suppression action against the grain growth is strong and the action does not uniformly affect on all grains. As a result, a severe mixed grain structure appears accompanied with irregular elongation of material during press-forming, which induces blurred periphery of pierced holes.

Boron also increases the gathering degree of the {211} plane after annealing, which causes the crack on a skirt of material. A boron content above 0.0030 wt.% significantly enhances the suppression of grain growth, and the austenite grain size aimed in the present invention can not be obtained. Also the blurred periphery of pierced holes during press-forming occurs, and the gathering degree of {211} plane exceeds the upper limit specified in the present invention. Based on these findings, the upper limit of B content is defined as 0.0030 wt.%.

(4) Silicon:

Silicon is used as the deoxidizer during ingot-making of the alloy. When the Si content exceeds 0.10 wt.%, an oxide film of Si is formed on the surface of alloy during the annealing before press-forming. The oxide film degrades the fitness to dies during press-forming and results in the galling of dies with alloy sheet. Consequently, the upper limit of Si content is specified as 0.10 wt.%. Less Si content further improves the fitness of dies and alloy sheet.

(5) Nitrogen:

Nitrogen is an element unavoidably entering into the alloy during ingot-making process. A nitrogen content of more than 0.0030 wt.% induces the concentration of N on the surface of alloy during the annealing before press-forming. The concentrated N on the surface of alloy degrades the fitness to dies during press-forming and induces galling of dies with the alloy sheet. Consequently, the upper limit of the content is specified as 0.0030 wt.%.

An alloy for a shadow mask of the present invention contains a specific amount of O, B, Si, and N in its Fe—Ni—Cr and Fe—Ni—Co—Cr basic composition, and has an average austenite grain size of 15 to 45 μm after annealing before press-forming, and has a degree of mixed grain for austenite grains of 50% or less, and has 20% or less, 35% or less, 20% or less of the gathering degree of the {211}, {331}, {210} plane, respectively. Most preferably, the composition further contains 0.0001 to 0.0040 wt.% C, 0,001 to 0.35 wt.% Mn, 0,001 to 0.05% Cr, and 2.0 ppm or less H.

As described above, the control of chemical composition and of average austenite grain size after annealing before press-forming within the range specified in the present invention suppresses the galling of dies with alloy during press-forming and gives a superior shape fixability. However, there remains the problem of crack generation on press-formed material. To cope with the problem, the inventors studied the relation between the crack generation and the crystal grain orientation during press-forming by changing the crystal grain orientation of the alloy sheet in various directions using the alloy sheets having chemical composition and average austenite grain size in the range specified in the present invention, and found that an effective condition to suppress the crack generation on the alloy material is to control the gathering degree of the {211} plane at or less than a specific value, as well as to control the average austenite grain size after the annealing before press-forming at or less than a specific level.

FIG. 1 shows the relation among crack generation on an alloy sheet during press-forming, the gathering degree of the {211} plane, and the average austenite grain size for the alloy sheet having a chemical composition specified in the present invention. The gathering degree of {211} plane is determined from the relative X-ray diffraction intensity ratio of the (422) diffraction plane of the alloy sheet after the annealing before press-forming divided by the sum the of the relative X-ray diffraction intensity ratio of (111), (200), (220), (311), (331), (420), and (422) diffraction planes. The measurement of the gathering degree of the {211} plane was carried by measuring the diffraction of the {422} plane which has equivalent orientation with the {211} plane.

The relative X-ray diffraction intensity ratio is defined as the value of X-ray diffraction intensity observed on each diffraction plane divided by the theoretical X-ray diffraction intensity of that diffraction plane. For example, the relative X-ray diffraction intensity ratio of the (111) diffraction plane is determined from the X-ray diffraction intensity of the (111) diffraction plane divided by the theoretical X-ray diffraction intensity of the (111) diffraction plane. The measurement of the gathering degree of the {331} and {210} planes, which will be described in detail later, was carried by measuring the relative X-ray diffraction intensity ratio of the (331) diffraction plane and the (420) diffraction plane (which have the equivalent factor with the {211} plane) divided by the sum of relative X-ray intensity ratio of seven diffraction planes from (111) to (422) described above, respectively.

FIG. 1 clearly shows that the case where an average austenite grain size is 15 to 45 μm and where the gathering degree of the {211} plane is 20% or less does not generate cracks on an alloy sheet during press-forming and does not induce blurred periphery of the pierced hole, which fact indicates the excellent effect of the present invention.

Based on the findings, the invention specifies the gathering degree of the {211} plane as 20% or less as the condition to suppress crack generation on the alloy sheet.

Figure 2:
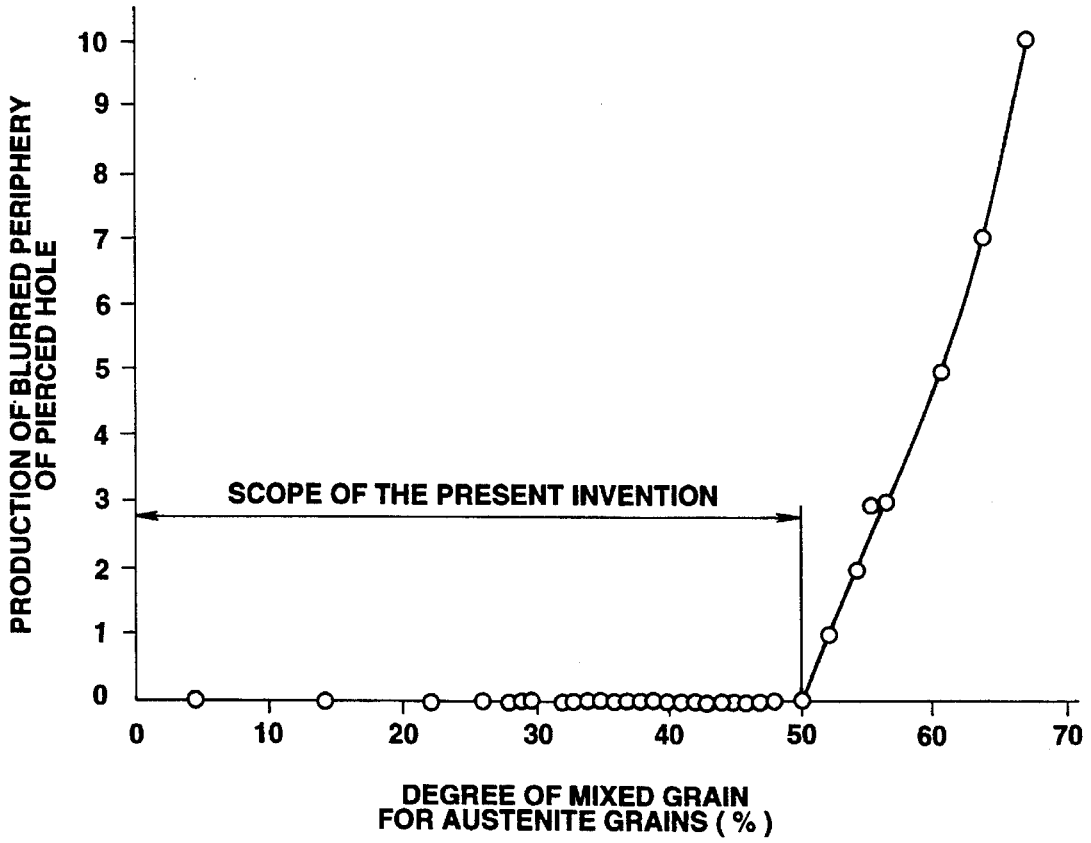
FIG. 2 is a graph showing a relation between the blurred periphery of pierced holes at press-forming and degree of mixed grain for austenite grains according to the present invention.

Adding to the measures above described, the control of degree of mixed grain for austenite grains after the annealing before press-forming is necessary to prevent the generation of blurred periphery of the pierced hole during press-forming. FIG. 2 shows the relation between the frequency of blurred periphery of the pierced hole and degree of mixed grain for austenite grains after press-forming using an alloy sheet having chemical composition, average austenite grain size and the gathering degrees of the {331}, {210}, and {211} planes within the range specified in the present invention. The figure indicates that the degree of mixed grain for austenite grains more than 50% increases the frequency of blurred periphery of pierced hole. Consequently, the degree of mixed grain for austenite grains to suppress generation of blurred periphry of the pierced hole after press-forming is specified as 50% or less.

As detailed above, with the specification of O, B, Si, and N content and of the average austenite grain size and the degree of mixed grain after annealing before press-forming and of gathering degree of the {211} plane, the press-formability aimed in the present invention becomes sufficient.

To suppress partial color-phase shift, the control of gathering degrees of the {331} plane and {210} plane after annealing before press-forming is important, which is described before. When the gathering degrees of each of the {331} and the {210} planes exceeds 35% and 20% after annealing before press-forming, respectively, partial color-phase shift will occur. Consequently, this invention specifies the degrees of the {331} plane and the {210} plane as 35% or less and 20% or less, respectively.

The method to keep the gathering degrees of the {331}, {210}, and {211} planes after annealing before press-forming at or less than 35%, 16%, and 20% is to adopt the alloy sheet manufacturing condition which prevent aggregation of the {331}, {210}, and {211} planes during the steps of solidification, hot-rolling, cold-rolling, and annealing of this alloy sheet as far as possible. For example, when the alloy is manufactured from a hot-rolled strip prepared from slabs or continuous casting slabs through ingot-making and slabbing, the hot-rolled strip is subjected to annealing of hot-rolled sheet, cold-rolling, recrystallization annealing, finish cold-rolling, stress relief annealing, annealing before press-forming, press-forming, and blackening. In the process, adequate annealing of hot-rolled sheet after hot-rolling is effective to prevent gathering of the {331}, {210}, and {211} planes. Particularly when the temperature of the annealing of hot-rolled sheet is adequately selected in the range of 810° to 890° C., the gathering degrees of {331}, {210}, and {211} planes can be kept at or less than the level specified in this invention.

Consequently, the present invention specifies the annealing temperature of the hot-rolled sheet as 810° to 890° C. which provides the gathering degree of the {331} plane of 35% or less, the degree of the {210} plane of 20% or less, and the degree of the {211} plane of 20% or less.

The effect of annealing of hot-rolled sheet in the present invention is performed when the hot-rolled alloy strip is fully recrystallized before the annealing of hot-rolled sheet. To obtain the satisfactory gathering degrees of the {331}, {210}, and {211} planes being focused on in the present invention, the uniform heat treatment of the slab after slabbing is not preferable. For example, when a uniform heat treatment is carried at a temperature of 1200° C. or more for a period of 10 hours or more, at least one of the gathering degrees of the {331}, {210}, and {211} planes exceeds the range specified in the present invention. Therefore, such a uniform heat treatment must be avoided. In addition, when the above described hot-rolled strip is used in the manufacturing process, the optimization of all conditions in the cold-rolling, annealing, finish cold-rolling, stress-relief annealing, and annealing before press-forming are required to assure the gathering degrees of {331}, {210}, and {211} planes and the degree of mixed grain for austenite grains to be in the range specified in this invention.

After the annealing of hot-rolled sheet, the optimization of conditions of cold-rolling and annealing is important to control the gathering degree of mixed grain for austenite grains after annealing before press-forming.

Figure 3:
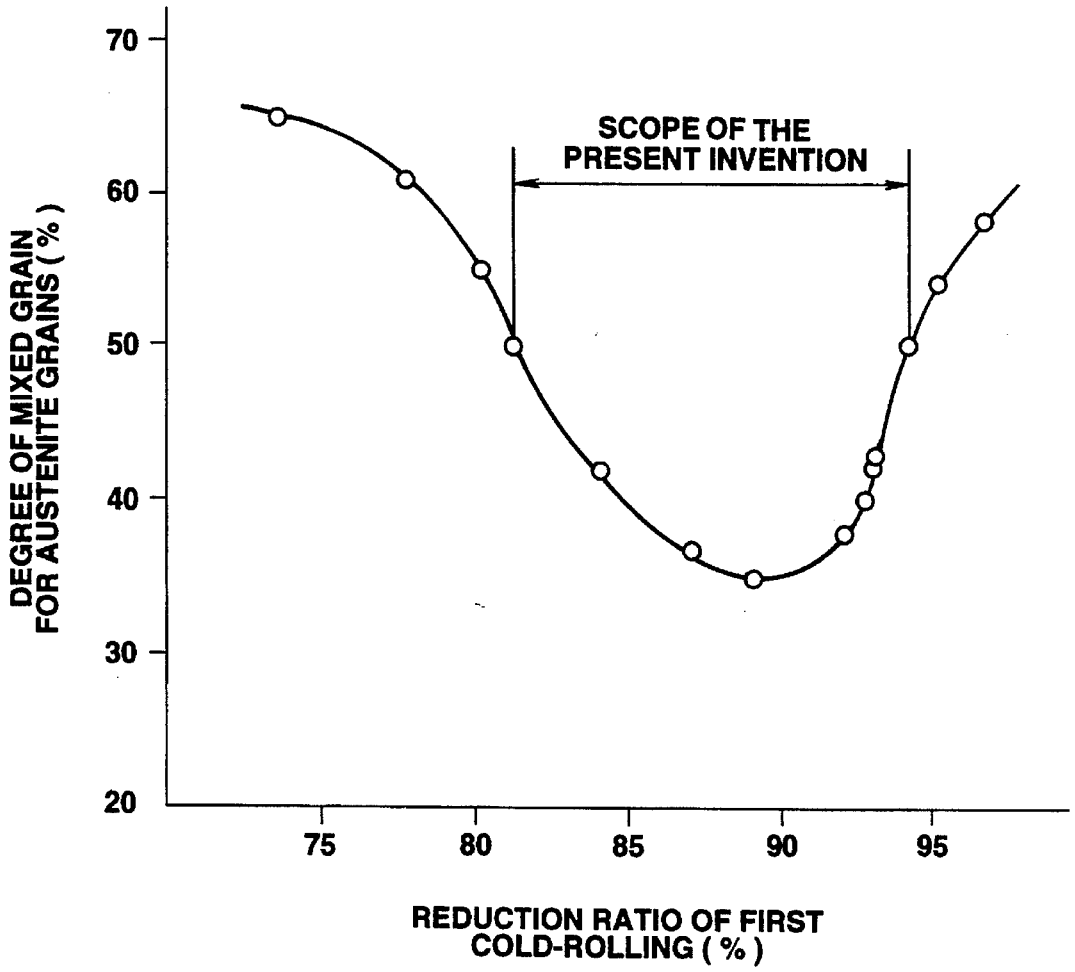
FIG. 3 is a graph showing a relation between the degree of mixed grain for austenite grains and the reduction ratio of first cold-rolling where the process includes only one cold-rolling, according to the present invention.

An alloy of the present invention was subjected to annealing of hot-rolled sheet and single cycle of cold-rolling and annealing. FIG. 3 shows the relation between the reduction ratio of cold-rolling and the degree of mixed grain for austenite grains after annealing before press-forming. In concrete terms, this is the graph showing the relation between the degree of mixed grain for austenite grains and the reduction ratio of first cold-rolling of the alloy sheet prepared from hot-rolled strip which was subjected to the process including the annealing of hot-rolled sheet in the temperature range of 810° to 890° C., first cold-rolling at the reduction ratio of 73 to 97%, recrystallization, finish cold-rolling at the reduction ratio of 14 to 29%, and stress-relief annealing in the temperature range of 450° to 540° C. for 0.5 to 300 sec., followd by the annealing in the temperature range of 740° to 900° C. for 2 to 40 min. before press-forming.

FIG. 3 indicates that the reduction ratio of cold-rolling of 81 to 94% gives the degree of mixed grain for austenite grains of 50% or less when the process of intermediate cold-rolling and annealing are conducted only once. On the other hand, the reduction ratio of cold-rolling of less than 81% or more than 94% gives the degree of mixed grain for austenite grains of more than 50%. Consequently, the present invention specifies the reduction ratio of cold-rolling as 81 to 94% to secure the degree of mixed grain for austenite grains at or below 50% for single cycle of cold-rolling and annealing.

Figure 4:
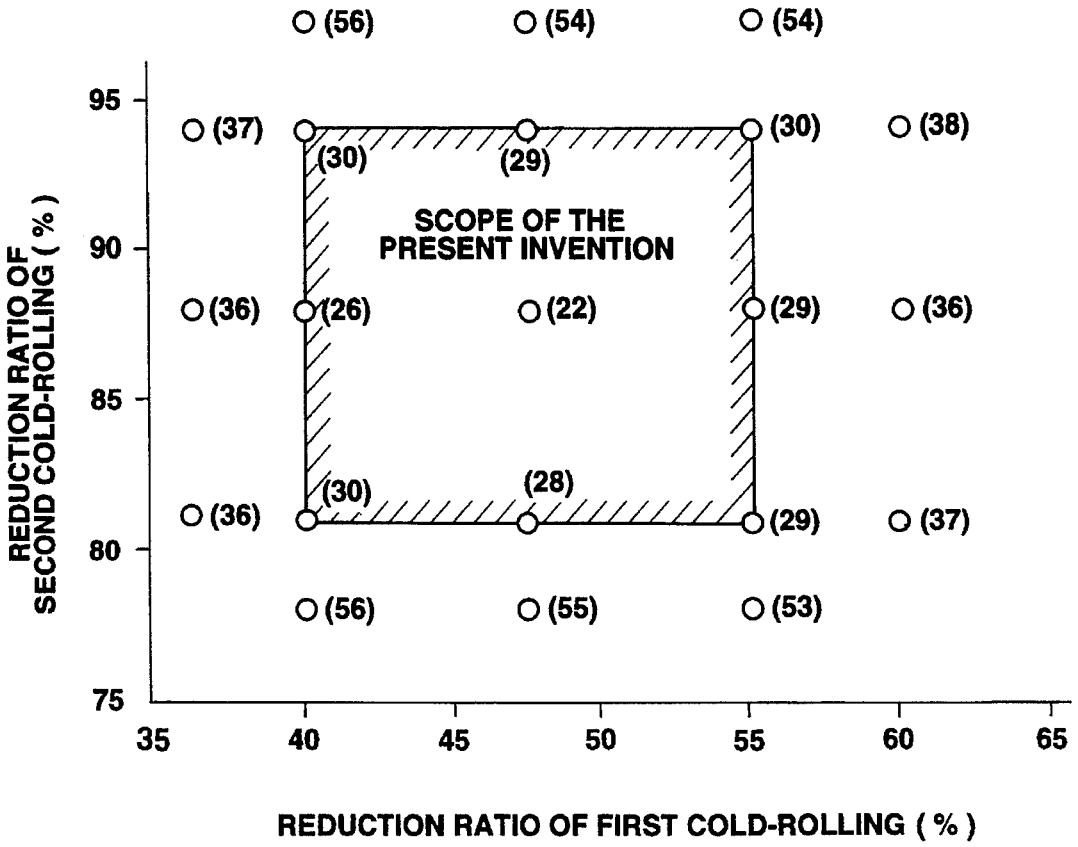
FIG. 4 is a graph showing a relation among the degree of mixed grain for austenite grains, reduction ratio of the first cold-rolling and reduction ratio of the second cold-rolling where the process includes two cold-rollings, according to the present invention.

FIG. 4 is a graph showing a relation between the reduction ratio of cold-rolling and a degree of mixed grain for austenite grains when the process of intermediate cold-rolling and annealing is performed twice. In concrete terms, this is the graph showing the relation between the degree of mixed grain for austenite grains and the reduction ratios of first cold-rolling and second cold-rolling of the alloy sheet prepared from hot-rolled strip which was subjected to the process including the annealing of hot-rolled sheet in the temperature range of 810° to 890° C., first cold-rolling at the reduction ratio of 35 to 60%, recrystallization annealing, second cold-rolling at the reduction ratio of 75 to 97%, recrystallization annealing, finish cold-rolling at the reduction ratio of 14 to 29%, and stress relief annealing in the temperature range of 450° to 540° C. for 0.5 to 300 sec., followed by annealing in the temperature range of 740° to 900° C. for 2 to 40 min. which annealing time (T) satisfying the equation of:

$$T \geqq -123 \log t + 937.$$

As shown in FIG. 4, the degree of mixed grain for austenite grains gives satisfactory value when the reduction ratio of second cold-rolling is 81 to 94% and the reduction ratio of first cold-rolling is 40 to 55%.

From the reasons described above, the present invention specifies the reduction ratio of first cold-rolling as 40 to 55% and that of second cold-rolling as 81 to 94% for the case of two cycles of cold-rolling and annealing. The recrystallization annealing after first and second cold-rolling is preferably carded at 810° to 840° C. for 0.5 to 3 min. Even when the annealing temperature exceeds the recrystallization temperature, the annealing at the temperature of 810° C. or less induces the formation of mixed grains, and the degree of mixed grain for austenite grains increases after the annealing before press-forming. Even if the temperature is kept in the range of 810° to 840° C., in the case of annealing of below 0.5 min. or over 3 min., the texture shows a mixed grain structure. The both latter two cases are unfavorable because of the increase of degree of mixed grain for austenite grains after annealing before press-forming.

When the conditions of cold-rolling and annealing which are described above are adopted, the gathering degrees of the {331}, {210}, and {211} planes becomes 35% or less, 20% or less, and 20% or less, respectively.

As for the reduction ratio of finish cold-rolling of 14 to 29%, when the conditions of chemical composition, cold-rolling, annealing, and annealing before press-forming are selected in the range specified in this invention, the resulted characteristics are: 15–45 μm of average austenite grain size; 50% or less of degree of mixed grain for austenite grains; 35% or less of gathering degree of the {331} plane; 20% or less of gathering degree of the {210} plane; and 20% or less of gathering degree of the {211} plane, after the annealing before press-forming. In the case that the reduction ratio of finish cold-rolling is less than 14% or more than 29%, at least one of the above described characteristics which are the feature of the present invention becomes out of the scope of the present invention. Consequently, the reduction ratio of finish cold-rolling is specified as 14 to 29%.

Figure 5:
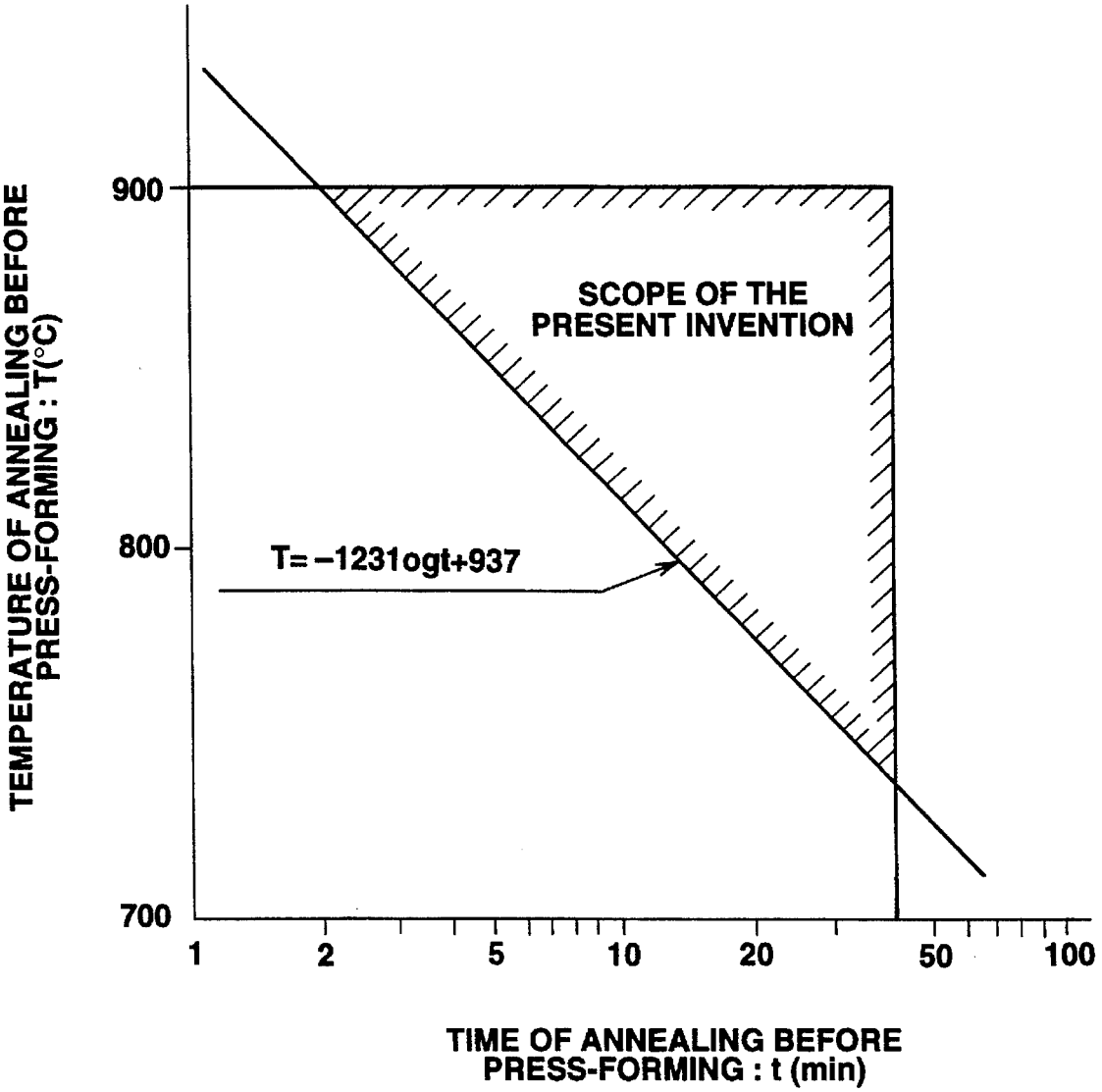
FIG. 5 is a graph showing the range of the condition of annealing before press-forming according to the present invention.

According to the present invention, the optimization of the condition of annealing before press-forming is also important to obtain the value of average austenite grain size, degree of mixed grain for austenite grains. FIG. 5 shows the relation among average austenite grain size, degree of mixed grain for austenite grains, gathering degrees of the {331}, {210}, and {211} planes after annealing before press-forming, and temperature (T, °C) and time (t, min.) of annealing before press-forming under the conditions of hot-rolled sheet annealing, cold-rolling and annealing, and the reduction ratio of finish cold-rolling within the range specified in the present invention.

As clearly shown in FIG. 5, even if all the conditions other than the condition of annealing before press-forming are within the range of the present invention, when the annealing temperature follows the relation of $T < -123 \log t + 937$, then the average austenite grain size is less than 15 μm and the gathering degree of the {211} plane is more than 20%, which values are not suitable for the present invention. When annealing temperature (T) exceeds 900° C., the average austenite grain size exceeds 45 μm and gathering degree of the {211} plane exceeds 20%, the values are inadequate. Furthermore, when annealing time (t) exceeds 40 min., at least one of the gathering degrees of the {211}, {331}, and {210} planes exceeds the specified range of the present invention, which is not suitable.

Consequently, the condition to obtain satisfactory values of average austenite grain size, degree of mixed grain for austenite grains, and the gathering degrees of {331}, {210}, and {211} planes is specified in the present invention as T: 740° to 900° C., t: 2 to 40 min., and $T \geqq -123 \log t + 937$. The stress relief annealing in the present invention is important to control the gathering degrees of {331}, {210}, and {211} planes in the succeeding annealing before press-forming. The stress relief annealing should be conducted at 450° to 540° C. for 0.5 to 300 sec. to demonstrate the sufficient effect aimed in the present invention.

There are other methods to limit the gathering degrees of the {331}, {210}, and {211} planes on the alloy sheet after the annealing before press-forming within the range specified in the present invention. Examples of these methods are quenching solidification and texture structure control through the control of recrystallization during hot-working. The annealing before press-forming in the present invention may be applied before photo-etching. In that case, desired photo-etching quality is ensured only when the condition of annealing before press-forming is kept within the range specified in this invention.

EXAMPLE

The present invention is described in more detail in the following referring to examples.

EXAMPLE -1

Slabs of No. 1 to No. 21 having chemical compositions listed in Table 1 were prepared by continuous casting a molten steel obtained by ladle refining. The chemical composition other than hydrogen is expressed by wt.% and the hydrogen content is expressed by p.p.m (pans per million) in Table 1.

The continuous cast slabs were subjected to scarfing, then heated at 1100° C. for 3 hrs in a heating furnace and hot-rolled to obtain hot-rolled strips. The hot-rolled strips were subjected to a process including annealing of hot-rolled sheet at 860° C., first cold-rolling at the reduction ratio of 93%, recrystallization annealing at 810° C. for 1 min. The process further includes finish cold-rolling at the reduction ratio of 21%, stress-relief annealing at 530° C. for 1 min. to obtain alloy sheets having 0.25 mm thickness. The alloy sheets obtained by the above described method were put to various experiments described below. The materials of No. 1 to No. 21 correspond to the alloys of No. 1 to No. 21. Said hot-rolled strips which were fully recrystallized after hot-rolling were selected.

The alloy sheets of materials No. 1 through No. 3, No. 5 through No. 21 were formed into flat masks by etching and then they were subjected to annealing before press-forming under the condition specified in Table 2 and to press-forming. The press-formed sheets were tested to determine the shape fixability, fitness to dies, crack generation on material, and frequency of blurred periphery of pierced holes based on the evaluation criteria given in Table 4. The materials were investigated for the corrosion resistance after stress relief annealing based on the evaluation criteria given in Table 4.

TABLE 2

| Material No. | Temperature of annealing of hot-rolled sheet (°C.) | Annealing condition before press-forming | |
|---|---|---|---|
| | | Temperature: T (°C.) | Time: t (min.) |
| 1 | 860 | 830 | 30 |
| 2 | 860 | 850 | 40 |
| 3 | 860 | 870 | 15 |

TABLE 1

| Material No. | Alloy No. | Chemical composition | | | | | | | | | |
|---|---|---|---|---|---|---|---|---|---|---|---|
| | | Ni | Si | O | N | B | C | Mn | H (ppm) | Co | Cr |
| 1 | 1 | 35.8 | 0.005 | 0.0011 | 0.0008 | 0.00005 | 0.0013 | 0.26 | 1.0 | — | 0.40 |
| 2 | 2 | 36.1 | 0.02 | 0.0013 | 0.0010 | 0.0001 | 0.0014 | 0.26 | 0.2 | — | 0.52 |
| 3 | 3 | 36.0 | 0.02 | 0.0014 | 0.0011 | 0.0001 | 0.0016 | 0.05 | 0.7 | 0.001 | 0.80 |
| 4 | 4 | 36.6 | 0.04 | 0.0022 | 0.0025 | 0.0005 | 0.0010 | 0.35 | 1.0 | 0.021 | 1.24 |
| 5 | 5 | 35.8 | 0.001 | 0.0015 | 0.0010 | 0.0002 | 0.0023 | 0.25 | 0.9 | — | 0.51 |
| 6 | 6 | 35.8 | 0.01 | 0.0018 | 0.0009 | 0.0001 | 0.0021 | 0.28 | 0.9 | 0.500 | 1.75 |
| 7 | 7 | 36.0 | 0.02 | 0.0009 | 0.0007 | 0.0002 | 0.0009 | 0.14 | 0.7 | — | 1.90 |
| 8 | 8 | 36.1 | 0.09 | 0.0006 | 0.0005 | 0.0001 | 0.0017 | 0.05 | 1.5 | 0.500 | 2.04 |
| 9 | 9 | 36.2 | 0.005 | 0.0002 | 0.0002 | 0.0001 | 0.0015 | 0.005 | 0.6 | 0.005 | 2.53 |
| 10 | 10 | 35.6 | 0.04 | 0.0014 | 0.0011 | 0.0001 | 0.0032 | 0.03 | 0.6 | — | 0.78 |
| 11 | 11 | 35.8 | 0.03 | 0.0017 | 0.0012 | 0.0002 | 0.0030 | 0.20 | 0.3 | — | 0.06 |
| 12 | 12 | 35.4 | 0.08 | 0.0019 | 0.0015 | 0.0011 | 0.0038 | 0.15 | 0.4 | 0.760 | 1.01 |
| 13 | 13 | 36.2 | 0.01 | 0.0018 | 0.0022 | 0.0022 | 0.0037 | 0.06 | 0.5 | 0.050 | 0.70 |
| 13-1 | 13-1 | 31.8 | 0.06 | 0.0020 | 0.0015 | 0.0030 | 0.0016 | 0.15 | 1.8 | 5.3 | 0.65 |
| 14 | 14 | 35.5 | 0.12 | 0.0020 | 0.0014 | 0.0002 | 0.0021 | 0.28 | 1.1 | — | 0.53 |
| 15 | 15 | 36.2 | 0.05 | 0.0035 | 0.0012 | 0.0001 | 0.0016 | 0.31 | 1.1 | — | 0.75 |
| 16 | 16 | 36.2 | 0.04 | 0.0018 | 0.0035 | 0.0002 | 0.0019 | 0.26 | 1.8 | 0.021 | 0.01 |
| 17 | 17 | 36.0 | 0.03 | 0.0016 | 0.0015 | 0.0035 | 0.0025 | 0.28 | 1.2 | 0.012 | 0.42 |
| 18 | 18 | 35.7 | 0.05 | 0.0033 | 0.0016 | 0.0021 | 0.0032 | 0.27 | 1.3 | — | 0.56 |
| 19 | 19 | 36.2 | 0.01 | 0.0018 | 0.0022 | 0.0022 | 0.0037 | 0.06 | 0.6 | 0.050 | 0.70 |
| 20 | 20 | 36.2 | 0.01 | 0.0018 | 0.0022 | 0.0022 | 0.0037 | 0.06 | 0.5 | 0.050 | 0.70 |
| 21 | 21 | 36.2 | 0.01 | 0.0018 | 0.0022 | 0.0022 | 0.0037 | 0.06 | 0.5 | 0.050 | 0.70 |

TABLE 2-continued

| Material No. | Temperature of annealing of hot-rolled sheet (°C.) | Annealing condition before press-forming: Temperature: T (°C.) | Annealing condition before press-forming: Time: t (min.) |
|---|---|---|---|
| 4 | 860 | 880 | 3 |
| 5 | 860 | 750 | 40 |
| 6 | 860 | 790 | 25 |
| 7 | 860 | 760 | 40 |
| 8 | 860 | 820 | 20 |
| 9 | 860 | 830 | 15 |
| 10 | 860 | 870 | 40 |
| 11 | 860 | 840 | 20 |
| 12 | 860 | 900 | 40 |
| 13 | 860 | 890 | 30 |
| 13-1 | 860 | 890 | 30 |
| 14 | 860 | 760 | 40 |
| 15 | 860 | 760 | 40 |
| 16 | 860 | 760 | 40 |
| 17 | 860 | 760 | 40 |
| 18 | 860 | 760 | 40 |
| 19 | 800 | 770 | 40 |
| 20 | 920 | 790 | 40 |
| 21 | 860 | 920 | 40 |

The flat masks after etching described above were found to have no blurred perifery of pierced hole and have sufficient etching performance. Their average austenite grain size, degree of mixed grain for austenite grains, tensile properties (n value, r value, and elongation) and gathering degree of the {331}, {210}, and {211} planes were determined after annealing before press-forming. The gathering degree of each of the {331}, {210}, and {211} planes was determined by X-ray diffraction method which was described before. The result is shown in Table 3.

annealing before press-forming under the condition given in Table 2, and to etching to form a flat mask followed by press-forming. The characteristics of the material were determined by the same methods applied to other materials. Partial color-phase shift was determined after blackening the press-formed shadow mask, assembling the mask into the cathode ray tube, and irradiating electron beam onto the cathode ray tube for a specified period. Table 4 shows the result of experiments of press-formablity (shape fixability, fitness to die, crack generation on alloy sheet, blurred periphery of pierced hole), partial color-phase shift and corrosion resistance (generation of spot rust; number/100 $cm^2$).

TABLE 3

| Material No. | Alloy No. | Average austenite grain size after annealing before press-forming (μm) | Degree of mixed grain for average austenite grain size after annealing before press-forming (%) | Gathering degree of crystal plane on the alloy sheet surface (%): (331) | (210) | (211) | Mechanical property after annealing before press-forming: n value | r value | Elongation (%) |
|---|---|---|---|---|---|---|---|---|---|
| 1 | 1 | 32 | 39 | 22 | 13 | 19 | 0.32 | 0.93 | 42.1 |
| 2 | 2 | 35 | 36 | 21 | 10 | 16 | 0.34 | 0.96 | 42.0 |
| 3 | 3 | 33 | 35 | 19 | 10 | 9 | 0.33 | 0.95 | 42.2 |
| 4 | 4 | 16 | 32 | 14 | 6 | 20 | 0.31 | 0.93 | 41.8 |
| 5 | 5 | 16 | 32 | 20 | 13 | 7 | 0.31 | 0.93 | 42.8 |
| 6 | 6 | 18 | 40 | 18 | 12 | 18 | 0.31 | 0.95 | 42.3 |
| 7 | 7 | 19 | 38 | 22 | 9 | 20 | 0.31 | 0.94 | 41.1 |
| 8 | 8 | 21 | 38 | 14 | 11 | 6 | 0.31 | 0.95 | 43.3 |
| 9 | 9 | 24 | 36 | 13 | 10 | 19 | 0.33 | 0.95 | 40.9 |
| 10 | 10 | 40 | 47 | 28 | 8 | 20 | 0.36 | 0.95 | 41.1 |
| 11 | 11 | 28 | 33 | 14 | 7 | 12 | 0.33 | 0.98 | 42.6 |
| 12 | 12 | 45 | 44 | 30 | 15 | 20 | 0.38 | 1.20 | 40.9 |
| 13 | 13 | 41 | 40 | 27 | 14 | 4 | 0.36 | 1.05 | 43.2 |
| 13-1 | 13-1 | 41 | 38 | 23 | 13 | 6 | 0.35 | 1.05 | 42.5 |
| 14 | 14 | 19 | 50 | 19 | 4 | 12 | 0.28 | 0.86 | 40.0 |
| 15 | 15 | 13 | 60 | 22 | 14 | 17 | 0.29 | 0.81 | 38.5 |
| 16 | 16 | 20 | 48 | 24 | 10 | 16 | 0.29 | 0.80 | 40.0 |
| 17 | 17 | 12 | 56 | 17 | 12 | 30 | 0.28 | 0.74 | 36.8 |
| 18 | 18 | 14 | 63 | 18 | 12 | 34 | 0.28 | 0.82 | 35.0 |
| 19 | 19 | 21 | 46 | 33 | 21 | 20 | 0.30 | 0.91 | 40.2 |
| 20 | 20 | 25 | 43 | 38 | 15 | 19 | 0.30 | 0.91 | 40.2 |
| 21 | 21 | 52 | 50 | 29 | 13 | 23 | 0.28 | 0.88 | 33.1 |

The alloy sheet of material No. 4 was subjected to stress relief annealing under the condition described above,

TABLE 4

| Material No. | Alloy No. | Press-formability: Shape fix ability | Fitness to die | Cracking on the alloy sheet | Blurred periphery of the pierced hole | Partial color phase shift | Corrosion resistance: Generation of spot rust (number/100 cm$^2$) |
|---|---|---|---|---|---|---|---|
| 1 | 1 | ◎ | ○ | No | 0 | No | 4 |
| 2 | 2 | ◎ | ○ | No | 0 | No | 4 |
| 3 | 3 | ◎ | ○ | No | 0 | No | 3 |
| 4 | 4 | ○ | ○ | No | 0 | No | 2 |
| 5 | 5 | ○ | ○ | No | 0 | No | 4 |
| 6 | 6 | ○ | ○ | No | 0 | No | 1 |
| 7 | 7 | ○ | ○ | No | 0 | No | 1 |
| 8 | 8 | ○ | ○ | No | 0 | No | 1 |
| 9 | 9 | ○ | ○ | No | 0 | No | 0 |
| 10 | 10 | ◎ | ○ | No | 0 | No | 3 |
| 11 | 11 | ◎ | ○ | No | 0 | No | 6 |
| 12 | 12 | ◎ | ○ | No | 0 | No | 2 |
| 13 | 13 | ◎ | ○ | No | 0 | No | 4 |
| 13-1 | 13-1 | ◎ | ○ | No | 0 | No | 4 |
| 14 | 14 | ○ | X | No | 0 | No | 4 |
| 15 | 15 | X | ○ | Yes | 5 | —* | 3 |
| 16 | 16 | ○ | X | No | 0 | No | 20 |
| 17 | 17 | X | ○ | Yes | 3 | —* | 4 |
| 18 | 18 | X | ○ | Yes | 7 | —* | 4 |
| 19 | 19 | ○ | ○ | No | 0 | Yes | 3 |
| 20 | 20 | ○ | ○ | No | 0 | Yes | 3 |
| 21 | 21 | ○ | ○ | Yes | 4 | No | 3 |

*Impossible to evaluate

1) Criteria for evaluation: ◎: very good, ○: good, Δ: rather poor, X: poor.

2) Criteria for evaluation: ○: good without ironing mark, Δ: rather poor with a few ironing marks, X: poor with lots of ironing marks.

3) The corrosion resistance was evaluated by salt spray test performed for 100 hrs according to the standard of JISZ2371.

As Table 4 clearly indicates, materials No. 1 through No. 13 and material No. 13-1 having chemical composition, gathering degrees of the {331}, {210}, and {211} plane, average austenite grain size, and degree of mixed grain for austenite grains within the range specified in the present invention, show high press-formability without inducing partial color-phase shift and have corrosion resistance better than material No. 16 described later. Material No. 4 was etched after annealing before press-forming, and the flat mask prepared from the material induced no blurred periphery of pierced hole and showed satisfactory etching performance. Material No. 13-1 which includes more Co than other materials showed characteristics as excellent as others.

On the contrary, material No. 14 gives Si content of 0.12 wt.% and material No. 16 gives N content of 0.0035 wt.%, which are more than the upper limit of the present invention, and raises problem of fitness to dies. Material No. 15 gives O content of 0.0035 wt.%, which is more than the upper limit of the present invention and also gives average austenite grain size (referred to simply as "average grain size" hereafter) of 13 μm, which is less than the lower limit of this invention, results in a poor shape fixability, induces crack generation on alloy sheet, gives degree of mixed grain for austenite grains (referred to simply as "degree of mixed grain" hereafter) above the upper limit of the present invention and results in blurred periphery of pierced hole to raise problem of press-formability. Cr is not added to material No. 16, which shows cosrrosion resistance much inferior to those of the examples of the present invention.

Material No. 17 and No. 18 give B content of 0.0035 wt.% and 0.0033 wt.%, respectively, which are more than the upper limit of the present invention and give average grain sizes of 12 μm and 14 μm, respectively, which are less than the lower limit of the present invention, 15 μm, resulting in poor shape fixability. Also degrees of mixed grain of material No. 17 and No. 18 are 56% and 63%, respectively, which are more than the upper limit of the present invention, inducing blurred periphery of the pierced hole. The gathering degrees of the {211} plane of the materials are 30% and 34%, which are more than the upper limit of the present invention, 20%, inducing cracks on the alloy sheet, and raise problems of press-formability.

Also materials No. 19 show the degree of mixed grain of 21%, which are more than the upper limit of the present invention, 20%. Material No. 20 show the gathering degree of the {331} plane of 38%, which are more than the upper limit of the present invention, 38%. Both materials give partial color phase shift, causing quality problems of screen. Material No. 21 shows average grain size of 52 μm, which is more than the upper limit of the present invention, 45 μm, to generate cracks on the alloy sheet and induces blurred periphery of the pierced hole, which results in press-formability problem. Material No. 21 gives gathering degree of the {211} plane of 23%, which is more than the upper limit of the present invention, 20%, and the crystal orientation becomes more intense with the increase of average grain size under the condition of annealing before press-forming, at 920° C. for 40 min.

The above discussion clearly shows that Fe—Ni—Cr alloy sheet and Fe—Ni—Co—Cr alloy sheet for shadow mask having high press-forming quality, screen quality and corrosion resistance are prepared by adjusting the chemical composition, gathering degrees of the {331}, {210}, and {211} planes, average grain size, and degree of mixed grain within the range specified in the present invention.

Example 2

The hot-rolled strips of alloys No. 1 through No. 13 and No. 13-1 which were used in Example 1 were subjected to annealing of hot-rolled sheet under the temperature condition given in Table 5, cold-rolling at the reduction ratio in Table 5 (if the column of CR1 is blank, it indicates that single cold-rolling was carried applying the reduction ratio given in CR2; if both columns of CR1 and CR2 are filled, it indicate that two cold-rollings were carried applying the reduction ratio given in each column).

After cold-rolling, the materials were treated by recrystallization annealing at 810° C. for 1 min., finish cold-rolling at the reduction ratio of cold-rolling given in Table 5, stress relief annealing at 530° C. for 0.5 sec., to obtain alloy sheets of materials No. 22 through No. 47 each having 0.25 mm of thickness.

TABLE 5

| Material No. | Alloy No. | Temperature of annealing of hot-rolled sheet (%) | Reduction ratio of cold-rolling $CR_1$ % | Reduction ratio of cold-rolling $CR_2$ % | Reduction ratio of finish cold-rolling $CR_3$ % | Annealing condition before press-forming Temperature (T) | Annealing condition before press-forming Time (t, min.) |
|---|---|---|---|---|---|---|---|
| 22 | 1 | 800 | — | 93 | 21 | 850 | 30 |
| 23 | 2 | 900 | — | 93 | 21 | 810 | 40 |
| 24 | 6 | 860 | — | 95 | 21 | 830 | 10 |
| 25 | 12 | 860 | — | 80 | 21 | 860 | 20 |
| 26 | 4 | 860 | — | 93 | 40 | 840 | 10 |
| 27 | 5 | 860 | — | 93 | 12 | 880 | 40 |
| 28 | 5 | 860 | — | 93 | 21 | 920 | 20 |
| 29 | 9 | 860 | — | 93 | 21 | 840 | 50 |
| 30 | 8 | 860 | — | 93 | 21 | 800 | 7 |
| 31 | 1 | 880 | — | 94 | 16 | 740 | 40 |
| 32 | 1 | 840 | 40 | 94 | 16 | 790 | 20 |
| 33 | 2 | 880 | — | 89 | 29 | 790 | 35 |
| 34 | 5 | 870 | — | 92.7 | 16 | 810 | 13 |
| 35 | 4 | 890 | 55 | 88 | 21 | 810 | 25 |
| 36 | 4 | 840 | 55 | 81 | 29 | 810 | 40 |
| 37 | 3 | 810 | 47.5 | 88 | 17 | 850 | 6 |
| 38 | 6 | 870 | — | 84 | 17 | 850 | 15 |
| 39 | 9 | 850 | 40 | 81 | 26 | 850 | 40 |
| 40 | 10 | 870 | — | 87 | 21 | 870 | 4 |
| 41 | 7 | 840 | — | 92 | 26 | 870 | 15 |
| 42 | 7 | 820 | — | 81 | 29 | 870 | 40 |
| 43 | 8 | 830 | 47.5 | 94 | 16 | 900 | 2 |
| 44 | 11 | 810 | 40 | 88 | 21 | 900 | 5 |
| 45 | 13 | 830 | 47.5 | 81 | 29 | 900 | 10 |
| 46 | 12 | 860 | — | 93 | 21 | 900 | 40 |
| 47 | 13-1 | 830 | 47.5 | 81 | 29 | 900 | 10 |

Alloy sheets of materials No. 22 through No. 39, No. 41, No. 42, and No. 44 through No. 47 were etched and formed to flat masks. The flat masks were then treated by the annealing before press-forming under the condition given in Table 5 and by press-forming to determine the press-forming quality and partial color-phase shift generation, which characteristics are listed in Table 7. The results are shown in Table 6.

TABLE 6

| Material No. | Alloy No. | Press-formability: Shape fix ability | Fitness to die | Cracking on the alloy sheet | Blurred periphery of the pierced hole | Partial color phase shift |
|---|---|---|---|---|---|---|
| 22 | 1 | ○ | ○ | No | 0 | Yes |
| 23 | 2 | ○ | ○ | Yes | 0 | No |
| 24 | 6 | ○ | ○ | No | 2 | No |
| 25 | 12 | ○ | ○ | No | 3 | No |
| 26 | 4 | X | ○ | Yes | 0 | —* |
| 27 | 5 | ○ | ○ | Yes | 5 | Yes |
| 28 | 5 | ○ | ○ | Yes | 5 | No |
| 29 | 9 | ○ | ○ | Yes | 0 | Yes |
| 30 | 8 | X | ○ | Yes | 0 | —* |

TABLE 6-continued

| Material No. | Alloy No. | Press-formability: Shape fix ability | Fitness to die | Cracking on the alloy sheet | Blurred periphery of the pierced hole | Partial color phase shift |
|---|---|---|---|---|---|---|
| 31 | 1 | ○ | ○ | No | 0 | No |
| 32 | 1 | ○ | ○ | No | 0 | No |
| 33 | 2 | ◎ | ○ | No | 0 | No |
| 34 | 5 | ○ | ○ | No | 0 | No |
| 35 | 4 | ○ | ○ | No | 0 | No |
| 36 | 4 | ◎ | ○ | No | 0 | No |
| 37 | 3 | ○ | ○ | No | 0 | No |
| 38 | 6 | ◎ | ○ | No | 0 | No |
| 39 | 9 | ◎ | ○ | No | 0 | No |
| 40 | 10 | ○ | ○ | No | 0 | No |
| 41 | 7 | ◎ | ○ | No | 0 | No |
| 42 | 7 | ◎ | ○ | No | 0 | No |
| 43 | 8 | ○ | ○ | No | 0 | No |
| 44 | 11 | ○ | ○ | No | 0 | No |
| 45 | 13 | ◎ | ○ | No | 0 | No |
| 46 | 12 | ◎ | ○ | No | 0 | No |
| 47 | 13-1 | ◎ | ○ | No | 0 | No |

*Impossible to evaluate

Before these experiments, average austenite grain size, degree of mixed grains for austenite grain, gathering degrees of the {331}, {210} and {211} planes and mechanical properties (n value, r value, and elongation) were investigated. The results are shown in Table 7.

TABLE 7

| Material No. | Alloy No. | Average austenite grain size after annealing before press-forming (μm) | Degree of mixed grain for average austenite grain size after annealing before press-forming (%) | Gathering degree of crystal plane on the alloy sheet surface (%) (331) | (210) | (211) | Mechanical property after annealing before press-forming n value | r value | Elongation (%) |
|---|---|---|---|---|---|---|---|---|---|
| 22 | 1 | 34 | 47 | 34 | 23 | 20 | 0.30 | 0.90 | 40.3 |
| 23 | 2 | 27 | 45 | 32 | 10 | 22 | 0.30 | 0.84 | 38.2 |
| 24 | 6 | 16 | 59 | 28 | 15 | 14 | 0.30 | 0.90 | 40.0 |
| 25 | 12 | 30 | 55 | 24 | 11 | 6 | 0.30 | 0.90 | 40.0 |
| 26 | 4 | 13 | 43 | 30 | 15 | 14 | 0.27 | 0.83 | 37.3 |
| 27 | 5 | 42 | 60 | 26 | 21 | 23 | 0.29 | 0.82 | 37.0 |
| 28 | 5 | 48 | 49 | 19 | 17 | 25 | 0.28 | 0.85 | 34.4 |
| 29 | 9 | 46 | 50 | 38 | 13 | 30 | 0.27 | 0.70 | 34.0 |
| 30 | 8 | 13 | 41 | 23 | 14 | 26 | 0.26 | 0.74 | 37.0 |
| 31 | 1 | 15 | 50 | 22 | 7 | 18 | 0.32 | 0.98 | 42.4 |
| 32 | 1 | 18 | 30 | 13 | 5 | 11 | 0.32 | 1.06 | 42.8 |
| 33 | 2 | 26 | 35 | 26 | 6 | 18 | 0.33 | 0.92 | 42.2 |
| 34 | 5 | 16 | 40 | 20 | 10 | 15 | 0.31 | 0.94 | 41.9 |
| 35 | 4 | 25 | 29 | 20 | 9 | 14 | 0.33 | 0.98 | 42.0 |
| 36 | 4 | 28 | 29 | 10 | 1 | 6 | 0.34 | 1.16 | 42.8 |
| 37 | 3 | 16 | 22 | 13 | 4 | 9 | 0.31 | 1.04 | 42.8 |
| 38 | 6 | 29 | 42 | 22 | 5 | 14 | 0.33 | 0.93 | 41.7 |
| 39 | 9 | 35 | 30 | 15 | 2 | 10 | 0.35 | 1.01 | 42.8 |
| 40 | 10 | 19 | 37 | 23 | 4 | 16 | 0.34 | 0.98 | 42.0 |
| 41 | 7 | 30 | 38 | 18 | 5 | 12 | 0.34 | 0.98 | 42.3 |
| 42 | 7 | 40 | 50 | 29 | 10 | 17 | 0.35 | 0.92 | 42.2 |
| 43 | 8 | 17 | 29 | 8 | 4 | 2 | 0.32 | 1.21 | 43.5 |
| 44 | 11 | 25 | 26 | 11 | 3 | 5 | 0.33 | 1.06 | 43.3 |
| 45 | 13 | 31 | 28 | 23 | 7 | 13 | 0.34 | 0.98 | 41.8 |
| 46 | 12 | 46 | 45 | 30 | 16 | 20 | 0.36 | 1.21 | 41.8 |
| 47 | 13-1 | 30 | 28 | 24 | 7 | 13 | 0.35 | 0.98 | 41.6 |

These flat masks after etching described above showed no blurred periphery of the pierced hole and found to satisfy the required etching performance.

The alloy sheets of materials No. 40 and No. 43 were subjected to stress relief annealing under the condition described above and to annealing before press-forming under the condition given in Table 5 and to etching, then they were formed to flat masks and were press-formed. The characteristics of these materials were determined by the same method applied to other materials.

As indicated in Table 6 and Table 7, materials No. 31 through No. 47 have chemical composition within the range specified in the present invention and have the conditions of annealing of hot-rolled sheet, reduction ratio of first and second cold-rolling, finish cold-rolling, annealing before press-forming (temperature: T, °C., time: t, min.), gathering degree of the {331}, {210}, and {211} plane, average grain size, and degree of mixed grain within the range specified in the present invention. So the materials No. 31 through No. 47 show high press-formability without inducing partial color-phase shift. Materials No. 40 and No. 43 were etched after the annealing before press-forming. The flat masks prepared from the materials No. 40 and No. 43 showed no blurred periphery of the pierced hole and gave sufficient etching performance.

Material No. 47 including Co also shows the excellent characteristics.

Among the above described materials, materials No. 32, No. 35 through No. 37, No. 39, No. 43 through No. 45 and No. 47 were treated by two cold-rollings where the reduction ratio of first cold-rolling, CR1, was 40 to 55%, and they gave less (more preferable) degree of mixed grain than that of the materials of single cold-rolling (materials No. 31, No. 33, No. 34, No. 38, No. 40 through No. 42, No. 46).

On the contrary, material No. 22 was subjected to annealing of hot-rolled sheet at 800° C., which is less than the lower limit of the present invention, 810° C., material No. 23 was subjected to annealing of hot-rolled sheet at 900° C., which is more than the upper limit of the present invention. Both materials have the gathering degrees of the {210} and {211} planes more than the upper limit of the present invention. Material No. 22 gives partial color-phase shift which causes a problem of screen quality, and Material No. 23 gives cracking on the alloy sheet which gives a problem of press-formability.

Material No. 24 is subjected to one cold-rolling at the reduction ratio of 95%, which is more than the upper limit of the present invention, 94%, and material No. 25 was subjected to one cold-rolling at the reduction ratio of 80%, which is less than the lower limit of the present invention, 81%. Both materials give degrees of mixed grain of 59% and 55%, respectively, which are more than the upper limit of the present invention, that induce blurred periphery of the pierced hole to raise problem of press-formability. Material No. 26 was subjected to the one cold-rolling at the reduction ratio of 40%, which is more than the upper limit of the present invention, 29%, and material No. 27 was subjected to the one cold-rolling at the reduction ratio of 12%, which is less than the lower limit of the present invention, 14%. Material No. 26 gives average grain size of 13 μm, which is less than the lower limit of the present invention, 15μm, inducing a problem of the shape fixability to generate cracking on the alloy sheet. Material No. 27 gives a degree of mixed grain of 60%, which is more than the upper limit of the present invention, 50%, inducing blurred periphery of pierced hole. In addition, Material No. 27 gives the gathering degree of the {211} plane of 23%, which is more than the upper limit of the present invention, 20%, inducing cracking on the alloy sheet, and gives gathering degree of the {210} plane, which is more than the upper limit of the present invention, inducing partial color-phase shift.

Material No. 28 was subjected to the annealing before press-forming at 920° C., which is more than the upper limit of the present invention, 900° C., material No. 29 was subjected to the annealing before press-forming for 50 min., which is more than the upper limit of the present invention, 40 min., and as for material No. 30, annealing temperature (T) does not satisfy the equation of ($T \geqq -123\log t+937$). Material No. 28 gives average grain size of 48 μm, which is more than the upper limit of the present invention, 45 μm, inducing a problem of blurred periphery of the pierced hole. Material No. 28 also gives the gathering degree of the {211} plane of 25%, which is more than the upper limit of the present invention, 20%, inducing cracking on the alloy sheet.

Material No. 29 gives the gathering degree of the {331} plane of 38%, which is more than the upper limit of the present invention, 35%, inducing cracking on the alloy sheet and partial color phase shift.

Material No. 30 gives average grain size of 13 μm, which is less than the lower limit of the present invention, 15 μmm, inducing a problem of shape fix ability. Material No. 30 also gives the gathering degree of the {211} plane of 26%, which is more than the upper limit of the present invention, 20%, inducing cracking on the alloy sheet.

As described above in detail, control of the conditions of annealing of hot-rolled sheet, cold-rolling, reduction ratio of finish cold-rolling, and annealing before press-forming within the range specified in the present invention is as important as the chemical composition to be in the range specified in the present invention to provide the press-formability and screen quality intended by the present invention.

As seen in materials No. 4, No. 40, and No. 43 used in the embodiment, the flat masks obtained from Fe—Ni—Cr and Fe—Ni—Co—Cr alloy sheets having press-formability required by the present invention without generating partial color-phase shift show no blurred periphery of the pierced hole and give sufficient etching performance.

As clarified in Example 1 and Example 2, the case that the gathering degree of the {211} plane exceeds 20% and/or that average grain size is outside the scope of this invention provides low value of elongation, n value, and r value after annealing before press-forming compared with the preferred embodiment of the present invention. In addition, when the gathering degree of the {211} plane increases and average grain size is out of specific range, or when at least one of the condition is satisfied, these values are presumably decreased inducing crack generation during press-forming.

What is claimed is:

1. An alloy sheet of an alloy consisting essentially of 34 to 38 wt. % Ni, 0.05 to 3 wt. % Cr, 0.1 wt. % or less Si, 0.003 wt. % or less B, 0.003 wt. % or less O, 0.003 wt. % or less N and the balance being Fe;

said alloy sheet having an average austenite grain size of 15 to 45 μm and a degree of mixed grain for austenite grains of 4.5 to 50%, said degree of mixed grain being expressed by an equation of ($|0.5\ Dmax-D|/D)\times100$ (%), where D is an average austenite grain size, Dmax is a maximum austenite grain size in said alloy sheet, and $|0.5\ Dmax-D|$ means an absolute value of (0.5 Dmax−D); and a gathering degree of the {331} plane on a surface of said alloy sheet being 8 to 35%, a gathering degree of the {210} plane being 1 to 20% and a gathering degree of the {211} plane being 2 to 20%, each of said respective gathering degrees of planes being calculated by dividing a relative X-ray intensity ratio of each of the respective {331}, {210} and {211} diffraction planes by a sum of relative X-ray intensity ratios of the {111}, {200}, {220}, {311}, {331}, {420} and {422} diffraction planes.

2. The alloy sheet of claim 1, wherein said Ni content is 35 to 37 wt. %.

3. The alloy sheet of claim 1, wherein said Si content is 0.001 to 0.1 wt. %.

4. The alloy sheet of claim 3, wherein said Ni is in an amount of 35.5 to 36.5 wt. %; said O is in an amount of 0.0001 to 0,003 wt. %; and said N is an amount of 0.0001 to 0.003 wt. %.

5. The alloy sheet of claim 1, wherein said O content is 0.0001 to 0.003 wt. %.

6. The alloy sheet of claim 1, wherein said N content is 0.0001 to 0.003 wt. %.

7. The alloy sheet of claim 1, wherein said gathering degree of the {210} plane is 1 to 16%.

8. The alloy sheet of claim 1, wherein the degree of said mixed grain for austenite grains is 4.5 to 40%.

9. The alloy sheet of claim 1, produced by (a) hot-rolling a slab of the alloy of claim 1 into a hot-rolled strip;

(b) annealing said hot-rolled strip at a temperature of 810 to 890° C.;

(c) cold-rolling said annealed hot-rolled strip into a cold-rolled sheet;

(d) recrystallization annealing of said cold-rolled sheet;

(e) finish cold-rolling of said annealed cold-rolled sheet;

(f) stress relief annealing of said cold-rolled sheet from step (e); and (g) annealing, and press-forming, of said cold-rolled sheet from step (f).

10. An alloy sheet of an alloy consisting essentially of 34 to 38 wt. % Ni, 0.05 to 3 wt. % Cr, 1 wt. % or less Co, 0.1 wt. % or less Si, 0.003 wt. % or less B, 0.003 wt. % or less O, 0.003 wt. % or less N and the balance being Fe;

said alloy sheet having an average austenite grain size of 15 to 45 μm and a degree of mixed grain for austenite grains of 4.5 to 50%, said degree of mixed grain being expressed by an equation of:

$$(|.5\ Dmax-D|/D)\times100\ (\%),$$

where D is an average austenite grain size, Dmax is a maximum austenite grain size in said alloy sheet, and $|0.5\ Dmax-D|$ means an absolute value of (0.5 Dmax−D); and the gathering degree of the {331} plane of said alloy sheet being 8 to 35%, the gathering degree of the {210} plane being 1 to 20% and the gathering degree of the {211} plane being 2 to 20%, each of said respective gathering degrees of planes being calculated by dividing a relative X-ray intensity ratio of each of the respective {331}, {210} and {211} diffraction planes by a sum of relative X-ray intensity ratios of the {111}, {200}, {220}, {311}, {331}, {420} and {422} diffraction planes.

11. The alloy sheet of claim 10, wherein said Ni content is 35 to 37 wt. %.

12. The alloy sheet of claim 10, wherein said Co content is 0.001 to 1 wt. %.

13. The alloy sheet of claim 12, wherein said Ni is in an amount of 35.5 to 36.5 wt. %; said Si is in an amount of 0.001 to 0.1 wt. %; said O is in an amount of 0.0001 to 0.003 wt. %; and said N is in an amount of 0.0001 to 0.003 wt. %.

14. The alloy sheet of claim 10, wherein said Si content is 0.001 to 0.1 wt. %.

15. The alloy sheet of claim 10, wherein said O content is 0.0001 to 0.003 wt. %.

16. The alloy sheet of claim 10, wherein said N content is 0.0001 to 0.003 wt. %.

17. The alloy sheet of claim 10, wherein said gathering degree of the {210} plane is 1 to 16%.

18. The alloy sheet of claim, 10 wherein the degree of said mixed grain for austenite grains is 4.5 to 40%.

19. The alloy sheet of claim 10, produced by (a) hot-rolling a slab of the alloy of claim 8 into a hot-rolled strip;

(b) annealing said hot-rolled strip at a temperature of 810° to 890° C.;

(c) cold-rolling said annealed hot-rolled strip into a cold-rolled sheet;

(d) recrystallization annealing of said cold-rolled sheet;

(e) finish cold-rolling of said annealed cold-rolled sheet;

(f) stress relief annealing of said cold-rolled sheet from step (e); and (g) annealing and press-forming, of said cold-rolled sheet from step (f).

20. An alloy sheet of an alloy consisting essentially of 27 to 38 wt. % Ni, 0.05 to 3 wt. % Cr, over 1 to less than 7 wt. % Co, 0.1 wt. % or less Si, 0.003 wt. % or less B, 0,003 wt. % or less O, 0.003 wt. % or less N and the balance being Fe;

said alloy sheet having an average austenite grain size of 15 to 45 μm and a degree of mixed grain for austenite grains of 4.5 to 50%, said degree of mixed grain being expressed by an equation of:

$$(|0.5\ Dmax-D|/D)\times 100\ (\%),$$

where D is an average austenite grain size, Dmax is a maximum austenite grain size in said alloy sheet, and |0.5 Dmax−D| means an absolute value of (0.5 Dmax−D); and the gathering degree of the {331} plane of said alloy sheet being 8 to 35%, the gathering degree of the {210} plane being 1 to 20% and the gathering degree of the {211} plane being 2 to 20%, each of said respective gathering degrees of planes being calculated by dividing a relative X-ray intensity ratio of each of the respective {331}, {210} and {211} diffraction planes by a sum of relative X-ray intensity ratios of the {111}, {200}, {220}, {311}, {420} and {422} diffraction planes.

21. The alloy sheet of claim 20, wherein said Ni content is 30 to 33 wt. %.

22. The alloy sheet of claim 20, wherein said Co content is 3 to 6 wt. %.

23. The alloy sheet of claim 22, wherein said Ni is in an amount of 35.5 to 36.5 wt. %; said Si is in an amount of 0.001 to 0.1 wt. %; said O is in an amount of 0.001 to 0.003 wt. % and said N is in an amount of 0.0001 to 0.003 wt. %.

24. The alloy sheet of claim 20, wherein said Si content is 0.001 to 0.1 wt. %.

25. The alloy sheet of claim 20, wherein said O content is 0.001 to 0.003 wt. %.

26. The alloy sheet of claim 20, wherein said N content is 0.0001 to 0,003 wt. %.

27. The alloy sheet of claim 20, wherein said gathering degree of the {210} plane is 1 to 16%.

28. The alloy sheet of claim 20, wherein the degree of said mixed grain for austenite grains is 4.5 to 40%.

29. The alloy sheet of claim 20, produced by (a) hot-rolling a slab of the alloy of claim 16 into a hot-rolled strip;

(b) annealing said hot-rolled strip at a temperature of 810° to 890° C.;

(c) cold-rolling said annealed hot-rolled strip into a cold-rolled sheet;

(d) recrystallization annealing of said cold-rolled sheet;

(e) finish cold-rolling of said annealed cold-rolled sheet;

(f) stress relief annealing of said cold-rolled sheet from step (e); and (g) annealing and press-forming, of said cold-rolled sheet from step (f).

* * * * *